United States Patent [19]

Drevet

[11] Patent Number: 4,911,064

[45] Date of Patent: Mar. 27, 1990

[54] PISTON AND BARREL MACHINE WITH FIXED CENTERING TOGGLE TYPE JOINT

[76] Inventor: Michel Drevet, 75 rue Ernest Renan, 92310 Sevres, Hauts de Seine, France

[21] Appl. No.: 227,838

[22] Filed: Aug. 3, 1988

[30] Foreign Application Priority Data

Aug. 6, 1987 [FR] France ..... 87 11193

[51] Int. Cl.[4] ..... F01B 3/00

[52] U.S. Cl. ..... 92/71; 91/483; 74/60

[58] Field of Search ..... 92/12.2, 70, 71, 73; 417/272; 91/486, 485; 74/60

[56] References Cited

U.S. PATENT DOCUMENTS

| | | | |
|---|---|---|---|
| 3,157,995 | 11/1964 | Swift | 92/12.2 |
| 3,862,588 | 1/1975 | Bahrle et al. | 91/486 |
| 4,030,404 | 6/1977 | Meijer | 92/71 |
| 4,294,139 | 10/1981 | Bex et al. | 92/12.2 |
| 4,584,927 | 4/1986 | Mourrier et al. | 92/71 |

FOREIGN PATENT DOCUMENTS

| | | | |
|---|---|---|---|
| 0470124 | 8/1975 | U.S.S.R. | 74/60 |
| 1309343 | 3/1973 | United Kingdom | 74/60 |

*Primary Examiner*—Robert E. Garrett
*Assistant Examiner*—Thomas Denion
*Attorney, Agent, or Firm*—Morgan & Finnegan

[57] ABSTRACT

Rotary piston and barrel machine comprising a thrust plate inclined in relation to its geometrical spin axis which coicides with the geometrical axis of the barrel, the central part of the inclined plate comprising a spherical bearing which revolves freely around a fixed central toggle type joint anchored to the central part of the barrel, whereas the barrel is connected to a rigid peripheral housing, the central toggle type joint being integral with a rigid half shaft connected to the rear part of the housing, characterized by at least one rod connected rigidly to the toggle type joint, as well as to a piston disposed inside a bore of the barrel and subjected to the action of an under-pressure fluid so that at least one part of the axial stresses applied to the toggle type joint is transmitted to the barrel without being applied to the housing.

10 Claims, 2 Drawing Sheets

PISTON AND BARREL MACHINE WITH FIXED CENTERING TOGGLE TYPE JOINT

BACKGROUND OF THE INVENTION

This invention relates to a piston and barrel rotary machine for pumps, hydraulic motors or compressors.

The invention concerns at type of machine covered by the French patent application No. 85 15604 filed by the Applicant, the piston and barrel rotary machine comprising a thrust plate inclined in relation to its geometric rotation axis which coincides with the geometrical axis of the barrel, the central part of the inclined thrust plate comprising a spherical bearing which rotates freely around a fixed central toggle type joint rigidly connected to a rigid half shaft anchored directly into the central part of the barrel whilst the said barrel is connected by a rigid peripheral housing which covers the rear of a linkage assembly behind which it closes, and in this machine the central spherical toggle type joint is rigidly connected to a second rigid half shaft situated opposite the first one with which it is aligned, this second half shaft, via its opposed end, being rigidly anchored onto the rear part of the machine housing.

First of all, the invention seeks to transfer the various forces and stresses to which the toggle type joint is subjected on the barrel of the machine; it has actually been established that the barrel constitutes an extremely rigid unit, in opposition to the housing in which the thrust plate, and the movement transmitter are housed.

According to the invention, a new disposition is provided in which the housing is now only subjected to small stresses, which makes it possible to manufacture it as a lighter structure as before.

Moreover, the invention also automatically compensates the differential expansions which may occur when the machine is operating.

In addition, the invention also makes it possible, by submitting the thrust plate to a prestressing, to compensate the stresses exerted on it during operation.

Compensation of stresses to make the thrust plate practically floating in relation to the toggle type joint which carries it may only be exerted when the machine is operating so that the machine parts are not subjected to significant static loads when the machine is not operating.

SUMMARY OF THE INVENTION

In accordance with the invention, the piston and barrel rotary machine, comprising a thrust plate inclined in relation to its geometrical rotation axis which coincides with the geometrical axis of the barrel, the central part of the inclined thrust plate comprising a spherical bearing which rotates freely around a fixed central toggle type joint anchored to the central part of the barrel whilst the barrel is connected to a rigid peripheral housing, the central toggle type joint being integral with a rigid half shaft connected to the rear part of the housing, at least one rod being rigidly connected to the toggle type joint as well as a piston disposed inside a bore of the barrel and subjected to action of a pressurized fluid so that at least one part of the axial stresses applied to the toggle type joint is transmitted to the barrel without being applied to the housing.

Various other features of the invention also appear from reading the following detailed description.

By way of examples, in no way restrictive, forms for embodying the subject of the invention are shown on the annexed drawings.

BRIEF EMBODIMENT OF THE DRAWINGS

DETAILED DESCRIPTION OF THE INVENTION

Figure 1:
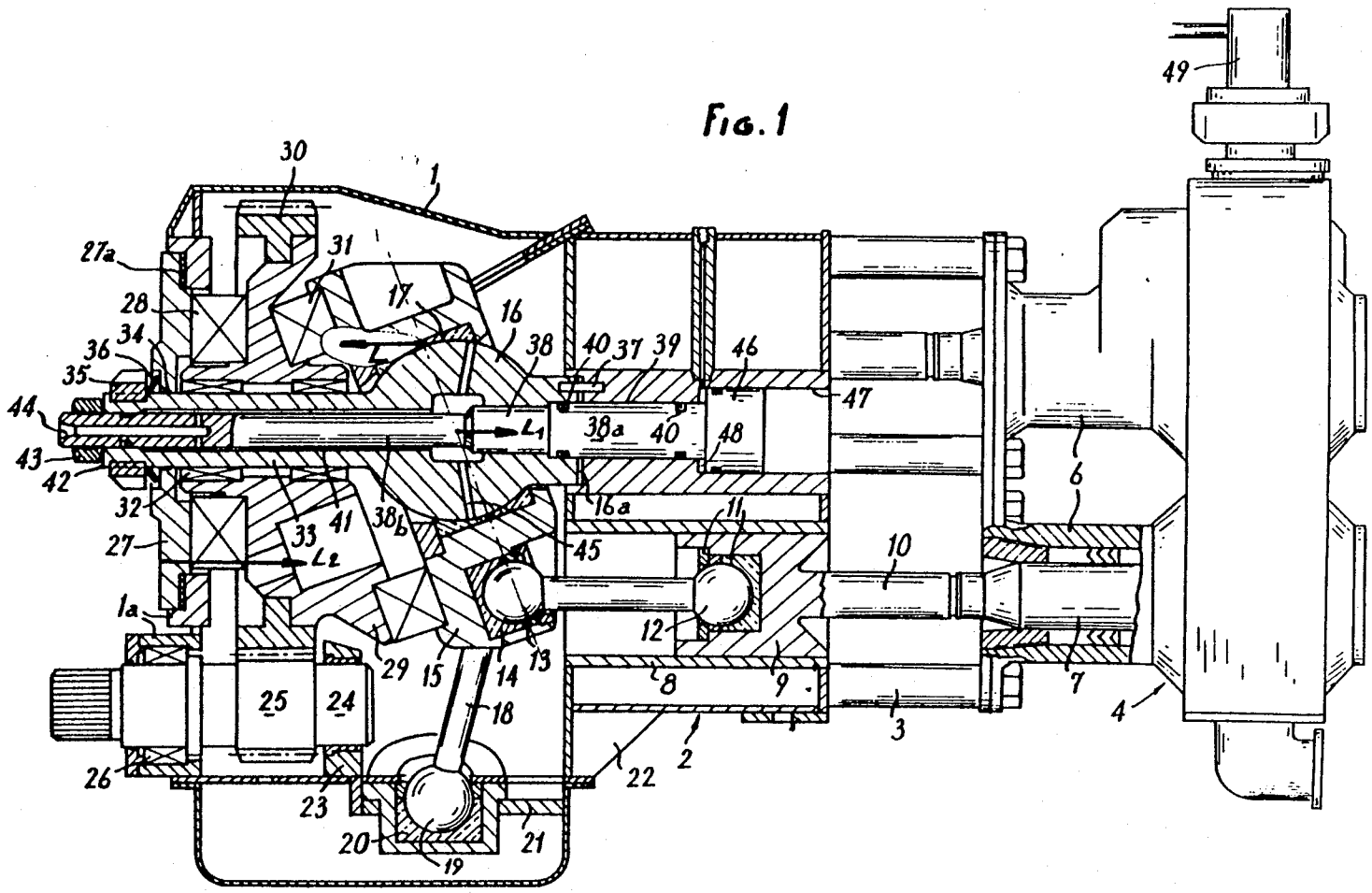
FIG. 1 is a vertical plan section of the machine according to the invention.

The machine shown according to the embodimentn of fig. 1 comprises a housing 1 connected to the peripheral part of a barrel 2 to which the rods 3 are secured, the tie rods 3 forming in the same time braces and being used to secure and support a body 4 delimiting cylinders 6 in which pistons 7 are provided to slide. The body 4 constitutes either a pump body or a motor body depending on whether the cylinders 6 are used to deliver a fluid or admit a fluid intended to drive the pistons 7.

In the type of machine the invention relates to, the body 4 is well-known, as well as the layout of the pistons 7 in the cylinders 6 and accordingly, this part of the machine is not described further.

The barrel 2 delimits sleeves 8, one of which is shown, and in each of the sleeves 8, it is possible to move a slide block 9 connected by a rod 10 to one of the pistons 7.

The slide block 9 contains bearings 11 for a spherical head 12 of a cylindrical connector rod whose foot 13 is also cylindrical and is pivotally mounted in one of a plurality of bearings 14 contained by an oscillating thrust plate 15.

The thrust plate 15 is carried by a toggle type joint 16 to which it is connected by hemispherical rings 17 forming a spherical bearing. The thrust plate 15 is prevented from freely rotating by a reaction connecting rod 18 pivotally mounted by its spherical head 19 in a footstep bearing 20 rigidly connected by a frame 21 which itself is connected both to the housing 1 and the barrel 2 by means of gussets 22.

The frame 21 forms a bearing support 23, for a primary shaft 24 provided with a pinion 25.

The primary shaft 24 is a also carried inside a bearing 26 connected to the rear part 1*a* of the housing 1. The rear part 1*a* referred to above is itself reinforced by a plate 27 able to form a thrust plate and which cooperates with the rear part 1*a* for supporting a thrust bearing 28 of a movement transmitter 29 constituted in the form of a bevelled disk comprising an annular gear 30 gearing with the pinion 25. The movement transmitter 29 carries a thrust bearing 31 connected to the oscillating thrust plate 15.

The movement transmitter 29 is carried by bearings 32 whose inner cage is attached to a half shaft made up of a tubular tail 33 rigidly connected to the toggle type joint 16, the tubular tail 33 being able, if required, to form a single part with the said toggle type joint 16.

The tubular tail 33 is coaxial with the geometrical axis of the barrel 2 and is inserted in an opening 34 of the plate 27.

A stop ring 35 is mounted, preferably being adjustable, on the extremity of the tubular tail 33 so as to take support, preferably via resilient means, for example a conical spring washer 36, against the plate 27.

It is an advantage, as shown in the drawing, that a preloading shim 27*a* is inserted between the plate 27 and the rear plate 1a of the housing. The thickness of the shim 27a is calculated so that adjustment of the respective values of the preload forces represented at $L_1$ and $L_2$ will be according to the desired distribution ratio. For example, it is possible to select that $L_1=L_2=L/2$.

In order to prevent that the toggle type joint 16 and tubular tail 33 from rotating, the part of the toggle type joint 16 turned to the barrel 2 is connected to the barrel 2 by means of a key 37.

The toggle type joint 16 is also carried by the threaded part of a rod 38 concentric to the tubular tail 33.

The rod 38 forms a a larger diameter part 38a guided into a bore 39 of the barrel 2 to which it is seal-connected by gathers 40. The rod 38 forms a smaller diameter part 38b which extends inside the tubular tail 33 and, along with the tubular tail 33, delimits an annular chamber 41.

The smaller diameter part 38b of the rod 38 is seal-connected to the tubular tail 33 by means of a sealing gasket 42 and is also connected mechanically to the tubular tail 33 by means of a stop counternut 43 which takes support on the free extremity of the tubular tail 33. The counternut 43 thus provides for blocking at the desired adjustment of the position of the rod 38 inside the toggle type joint 16 so as to leave a clearance 16a inside the housing on the barrel 2 of the front cylindrical part of the toggle type joint 16.

A channel 44 enables the above described annular chamber 41 to be connected to an pressurized fluid source (not shown), especially oil source, so that this oil is conveyed by the annular chamber 41 to distribution channels 45 provided inside the toggle type joint 16 and enabling the oil to be directed to the bearing forming hemispherical rings 17.

The larger diameter part 38a of the rod 38 is rigidly connected to a piston 46 disposed inside a cylinder 47 of the barrel 2. The rest face of the piston 46, along with the cylinder 48, delimits a chamber 48 for the admission of a pressurized adjustment fluid, especially oil derived from an adjustable source 49 connected to the body 4.

The source 49 may be constituted by a compressor or regulator applying in the chamber 48 a calibration pressure able, for example, to depend on the working pressure prevailing inside the body 4.

The unit formed by the barrel 2, tie rod 3 and body 4 constitutes an extremely rigid unit so that the pressure developed inside the chamber 48 may be a pressure sufficiently high to compensate at least one part of the oppposing forces applied to the toggle type joint 16 by the oscillating thrust plate 15 when the machine is operating.

The pressure in the chamber 48 exerted on the piston 46 is transmitted by the various parts of the rod 38 to the toggle type joint 16 and to the stop counter nut 43 bearing against the tubular tail 33, and the stop ring 35 can apply part of the tresses to the plate 27 supporting the bearing 28, without these forces being applied to the housing 1.

As a result of the foregoing disclosure, the clearance 16a provided inside the housing or the barrel 2 of the front cylindrical part of the toggle type joint 16 is in fact intended to control the travel of the piston 46 whose role is to pull the toggle type joint 16 so as to apply to it a part of the stresses during pumping with a view to relieve the thrust bearings 28 and 31.

By correctly selecting the pressure in the chamber 48, if desired, it is possible to ensure that all the stresses exerted axially on the toggle type joint 16 are transmitted by the tubular tail 33 without being transmitted to the housing 1 which may then be made of a specially light structure.

Given that the axial stresses are applied to the fluid mattress or cushion constituted in the chamber 48, the chamber 48 also acts as a compensator of the differential expansion able to exist between the tubular tail 33, the various parts of the rod 38 and the body of the barrel 2.

Figure 2:
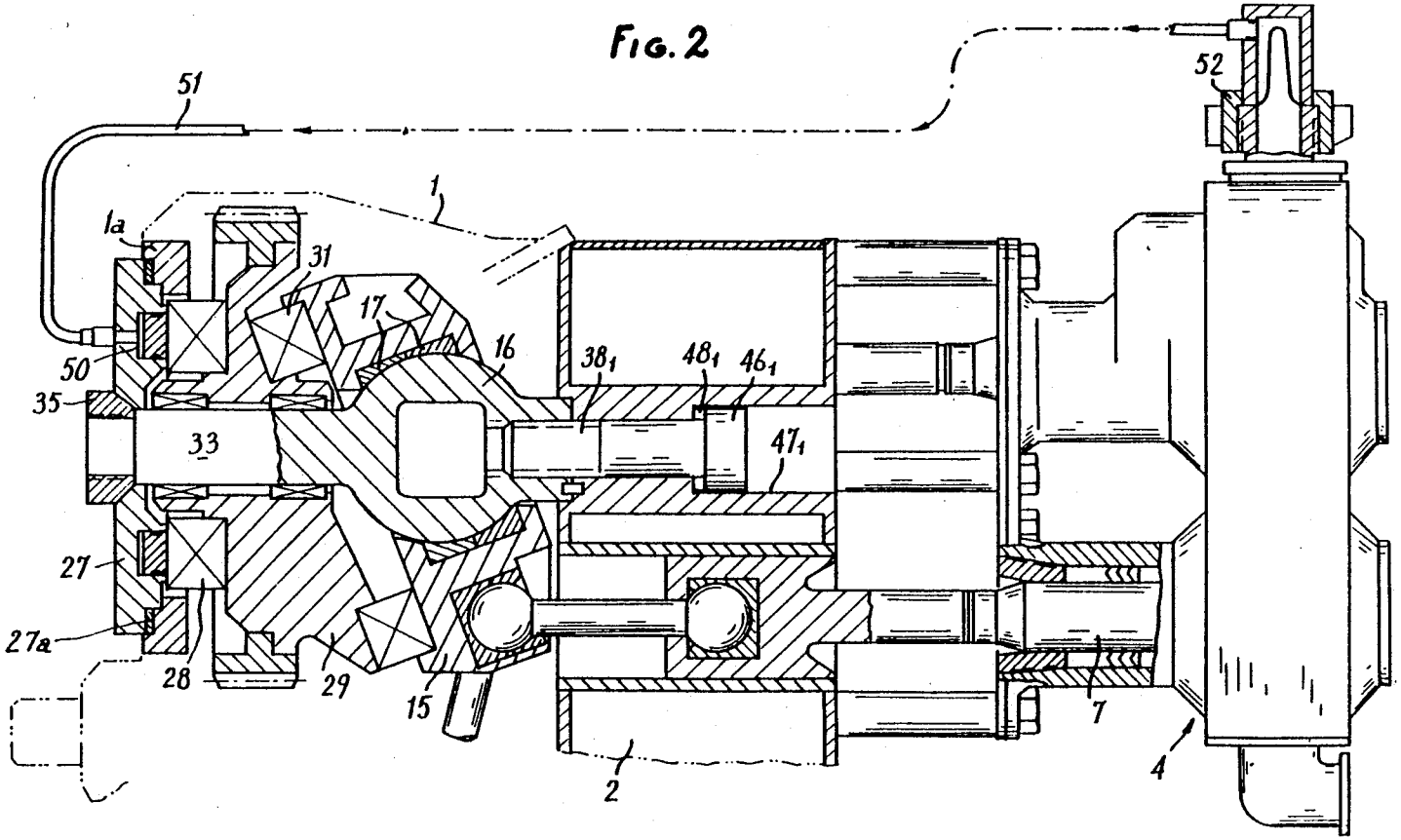
FIG. 2 is a vertical plan section, similar to FIG. 1, of a variant.

FIG. 2 illustrates a simplified variant according to which the same reference numbers denote the same devices as shown in FIG. 1.

According to FIG. 2, the toggle type joint 16 is directly secured to the threaded part of a rod $38_1$ itself connected to a piston $46_1$ delimiting, along with a cylinder $47_1$ of the barrel 2, a chamber $48_1$ so as to develop a compensation pressure.

Moreover, a hydraulic cylinder 50 is provided inside the plate 27 reinforcing the rear part 1a of the housing 1, the hydraulic cylinder 50 acting on the bearing 28 against which abuts the movement transmitter 29. The hydraulic cylinder 50 may consist, as shown diagrammatically, of an ordinary annular gasket.

The above-mentioned disposition, resulting from the preceding explanations and the drawing, allows for a distribution of the hydraulic pressures intended to balance the axial stresses, namely firstly on the barrel 2 and secondly on the plate 27. The pressure able to be exerted by the hydraulic cylinder 50 is applied to the movement transmitter 29 and by the thrust bearing 31 to the oscillating thrust plate 15, which makes it possible to reduce and virtually annul in certain operating conditions the axial loads between the toggle type joint 16 and the hemispherical rings 17 of the oscillating thrust plate 15.

FIG. 2 shows that the hydraulic cylinder 50 is connected via a duct 51 to a pressure regulator 52 which may be piloted by any suitable device, such as a computer for varying the compensation pressures exerted by the hydraulic cylinder 50 and the piston $46_1$ depending on the cyclic pressure variations exerted by the thrust plate 15 on the toggle type joint 16.

The use of the shim 27a in the embodiment of FIG. 2 provides additional safety in the event of failure of hydraulic compensation.

The invention is by no means restricted to the detailed illustrated examples of embodiment, a number of modifications being possible without departing from the context of the invention as shown in the appendent claims.

I claim:

1. A piston and barrel rotary machine comprising a thrust plate having a geometrical rotation axis and being inclined in relation to said geometrical rotation axis which coincides with a geometrical axis of the barrel, a central part of the inclined thrust plate comprising a spherical bearing which rotates freely around a fixed central toggle type joint anchored to a central part of the barrel, said barrel being connected to a rigid peripheral housing having a rear part, the central toggle type joint being integral with a rigid half shaft connected to said rear part of the housing, at least one rod connected rigidly to the toggle type joint as well as to a piston disposed inside a bore of the barrel and subjected to action of a pressurized fluid, wherein a clearance is further provided between the toggle type joint and the barrel for adjusting travel displacement of the piston, and wherein the rigid half shaft integral with the toggle type joint is opposite said at least one rod and takes support against a reinforcement plate secured to said rear part of the housing, said reinforcement plate forming a stop for a bearing of a movement transmitter provided for activating the inclined thrust plate via a thrust bearing.

2. A machine as set forth in claim 1, comprising a hydraulic cylinder inserted between the reinforcement plate against which is applied the half shaft and the bearing forming a stop for the movement transmitter connected to the inclined thrust plate via said thrust bearing, said hydraulic cylinder being fed with a pressurized fluid, whereby compensating at least part of axial stresses exerted on the inclined thrust plate.

3. A machine as set forth in claim 1 wherein the half shaft consists of a tubular tail formed from the toggle type joint, said tubular tail being crossed by part of said at least one rod and connected thereto by a stop nut.

4. A machine as set forth in claim 3, wherein the tubular tail and said part delimit an annular chamber connected to channels for bringing a lubricating fluid to the toggle type joint of the inclined thrust plate.

5. A machine as set forth in claim 1, wherein the half shaft consists of a tubular tail formed from the toggle type joint, said tubular tail taking support against said reinforcement plate via a stop ring.

6. A machine as set forth in claim 5, wherein an elastic device of the conical washer type is inserted between the stop ring and the reinforcement plate.

7. A machine as set forth in claim 1, wherein the machine is provided with a plurality of pistons, and wherein control means are further provided for controlling the pressure exerted on said piston according to the working pressures of said plurality of pistons.

8. A machine as set forth in claim 2, wherein the compensation pressures exerted by the hydraulic cylinder are determined according to the working pressures of the machine by means of a pressure regulator.

9. A machine as set forth in claim 2, wherein the compensation pressures exerted by the hydraulic cylinder are determined by a computer according to cyclic variations of the working pressures of the machine.

10. A machine as set forth in claim 1, further comprising a preload shim inserted between the reinforcement plate and the rear part of the housing.

* * * * *

UNITED STATES PATENT AND TRADEMARK OFFICE

CERTIFICATE OF CORRECTION

PATENT NO. : 4,911,064

DATED : March 27, 1990

INVENTOR(S) : MICHEL DREVET

It is certified that error appears in the above-identified patent and that said Letters Patent is hereby corrected as shown below:

Column 1, line 27, after "stresses" insert -- , --.
Column 1, line 28, after "subjected" insert -- , --.
Column 1, line 62, after "as" insert --to--.
Column 2, line 13, "embodimetn" should read --embodiment--.
Column 3, line 15, "gathers" should read --gaskets--.
Column 3, line 24, after "blocking" insert -- , --.
Column 3, line 24, after "adjustment" insert -- , --.
Column 3, line 25, delete "of".
Column 3, line 61, "or" should read --on--.

Signed and Sealed this

Twenty-sixth Day of March, 1991

*Attest:*

*Attesting Officer*

HARRY F. MANBECK, JR.

*Commissioner of Patents and Trademarks*